US012252333B2

(12) United States Patent
Park

(10) Patent No.: US 12,252,333 B2
(45) Date of Patent: Mar. 18, 2025

(54) CHOCOLATE CASE

(71) Applicant: Won Bin Park, Seoul (KR)

(72) Inventor: Won Bin Park, Seoul (KR)

( * ) Notice: Subject to any disclaimer, the term of this patent is extended or adjusted under 35 U.S.C. 154(b) by 479 days.

(21) Appl. No.: 17/624,877

(22) PCT Filed: Jun. 29, 2020

(86) PCT No.: PCT/KR2020/008421
§ 371 (c)(1),
(2) Date: Jan. 5, 2022

(87) PCT Pub. No.: WO2021/006510
PCT Pub. Date: Jan. 14, 2021

(65) Prior Publication Data
US 2022/0281677 A1 Sep. 8, 2022

(30) Foreign Application Priority Data
Jul. 5, 2019 (KR) ..... 20-2019-0002804

(51) Int. Cl.
*B65D 85/60* (2006.01)
*B65D 5/42* (2006.01)
*B65D 5/52* (2006.01)

(52) U.S. Cl.
CPC ..... *B65D 85/60* (2013.01); *B65D 5/4216* (2013.01); *B65D 5/4266* (2013.01); *B65D 5/5206* (2013.01)

(58) Field of Classification Search
CPC .... B65D 85/60; B65D 5/4216; B65D 5/4266; B65D 5/5206
USPC ..... 426/106
See application file for complete search history.

(56) References Cited

FOREIGN PATENT DOCUMENTS

| | | | | |
|---|---|---|---|---|
| JP | 7-24719 | U | | 5/1995 |
| JP | 3156041 | U | | 12/2009 |
| KR | 20-2013-0002200 | U | | 4/2013 |
| KR | 10-2016-0142491 | A | | 12/2016 |
| KR | 20160142491 | A | * | 12/2016 |
| WO | 2010/127741 | A1 | | 11/2010 |

OTHER PUBLICATIONS

Translation of KR-20160142491-A (Year: 2016).*
International Search Report dated Sep. 4, 2020 issued in corresponding PCT/KR2020/008421 application (2 pages).

* cited by examiner

*Primary Examiner* — Brent T O'Hern
(74) *Attorney, Agent, or Firm* — Millen, White, Zelano & Branigan P.C.; William F. Nixon

(57) ABSTRACT

The present invention comprises: a main body part having a plurality of printed surfaces that are partitioned so as to be exposed to the front; a chocolate part which has a plurality of accommodation regions that are partitioned so as to correspond to the printed surfaces, and which is formed so that the same designs as the designs of the printed surfaces are exposed to the front when placed inside the accommodation regions; and a support part which is provided at the rear of the main body part and which enables the main body part to be selectively supported.

6 Claims, 8 Drawing Sheets

CHOCOLATE CASE

TECHNICAL FIELD

The present invention relates to a chocolate case, and more particularly, to a chocolate case that can be used as a picture frame after the individually packaged chocolates are consumed.

BACKGROUND OF THE INVENTION

In general, most products such as chocolate are individually packaged and sold one by one in the case of chocolate in the form of a square plate. In addition, in the case of chocolate in the form of small grains, it is common to put the chocolate in a normal plastic bag, etc., and then sell it after packaging.

Recently, as consumers' tastes become more diversified, the demands for a new type of product are increasing. In addition, various new methods of packaging the product are being tried, thereby focusing on enhancing the commercial value of the product.

In addition, in the case of currently chocolate products, since the simple forms and packaging methods described above are mostly used, there is a limit in enhancing the commercial value. In addition, when these products are individually packaged and sold, they are often easily broken or damaged. In particular, in the case of chocolate products, the problems such as breakage greatly affect the commercial value, so improvement measures are required.

In addition, in the case of currently commercial chocolate cases in which a plurality of individually packaged chocolates is accommodated, it has only the purpose of accommodating the chocolates, not a design element. Accordingly, after all of the chocolates are consumed, they are actually thrown away together with the packaging paper. It is important to improve these problems in terms of preventing environmental pollution and resource waste so that the chocolate cases can be recycled.

BRIEF SUMMARY OF THE INVENTION

An object of the present invention is to provide a chocolate case, which has a plurality of partitioned accommodation regions, is formed so that the interior design of the accommodation regions is the same as the front surface design of chocolates, and is also capable of being selectively supported through cutting members provided to be unfold reward, such that the chocolate case can be recycled as a picture frame after the accommodated chocolates are consumed.

In order to achieve the above technical problem to be solved, a chocolate case according to the present invention may include: a main body part having a plurality of printed surfaces that are partitioned so as to be exposed to the front; a chocolate constituent part which has a plurality of accommodation regions that are partitioned so as to correspond to the printed surfaces, and which is formed so that the same designs as the designs of the printed surfaces are exposed to the front when placed inside the accommodation regions; and a support part which is provided at the rear of the main body part and which enables the main body part to be selectively supported.

In addition, the main body part may be made of a paper material, and may be configured to form the frames by folding along a plurality of cutting lines in a state where the printed surfaces are placed in the center.

In addition, the main body part may be made of any one of a plastic material manufactured by an injection molding or a processed wood material.

Herein, the support part is made of the same material as the material of the main body part.

Meanwhile, the chocolate constituent part may include: a seating frame in which the accommodation regions are partitioned and formed; printed packaging papers having the same front surface designs as the designs of the printed surfaces and placed in the accommodation regions at positions corresponding to the printed surfaces; and chocolates packaged by the printed packaging papers.

In addition, the chocolate constituent part may include: the seating frame in which the accommodation regions are partitioned and formed; and chocolates placed in the accommodation regions at the positions corresponding to the printed surfaces in a state in which the same designs as the designs of the printed surfaces are printed on their front surfaces.

In addition, the support part may include: a first support member made of a paper material and formed to be selectively unfolded along the first cutting line; a second support member made of the same material as the first support member and formed to be selectively unfolded along a second cutting line at a position symmetrical to the first cutting line with respect to the rear center of the main body part; and a fixing member selectively unfolded along a third cutting line connecting the first cutting line and the second cutting line, and fitted in a longitudinal direction of the first and second support members.

In addition, the support part may include: a connection member coupled to the rear of the main body part; and a support member rotatably coupled to the connecting member and formed to be selectively unfolded.

In addition, the main body part is provided so that all the same designs are formed on the printed surfaces, or different designs are formed on the printed surfaces.

Advantageous Effects

According to the present invention, a chocolate case may be provided, which has a plurality of partitioned accommodation regions, is formed so that the interior design of the accommodation regions is the same as the front surface design of chocolates, and is also capable of being selectively supported through cutting members provided to be unfold reward. Accordingly, the present invention has an effect in that the chocolate case can be recycled as a picture frame after the accommodated chocolates are consumed.

In addition, according to the present invention, since the consumers can permanently possess the chocolate case having the same designs as the front surface designs of the chocolates, and the discarded chocolate case can be used as a picture frame, the present invention has the effect improving the problems of environmental pollution and resource waste.

DETAILED DESCRIPTION OF THE INVENTION

Hereinafter, the preferred embodiments according to the present invention will be described in detail with reference to the accompanying drawings.

Advantages and features of the present invention, and a method for achieving the same, will become apparent with reference to the embodiments described below in detail in conjunction with the accompanying drawings.

However, the present invention is not limited by the embodiments disclosed below, but will be embodied in various different forms, and only these embodiments are provided to complete the disclosure of the present invention. In addition, the present invention is provided to completely inform those of ordinary skill in the art to which the present invention pertains to the scope of the invention, and the present invention is only defined by the scope of the claims.

In addition, in the description of the present invention, if it is determined that related known technologies may obscure the gist of the present invention, the detailed description thereof will be omitted.

Figure 1:
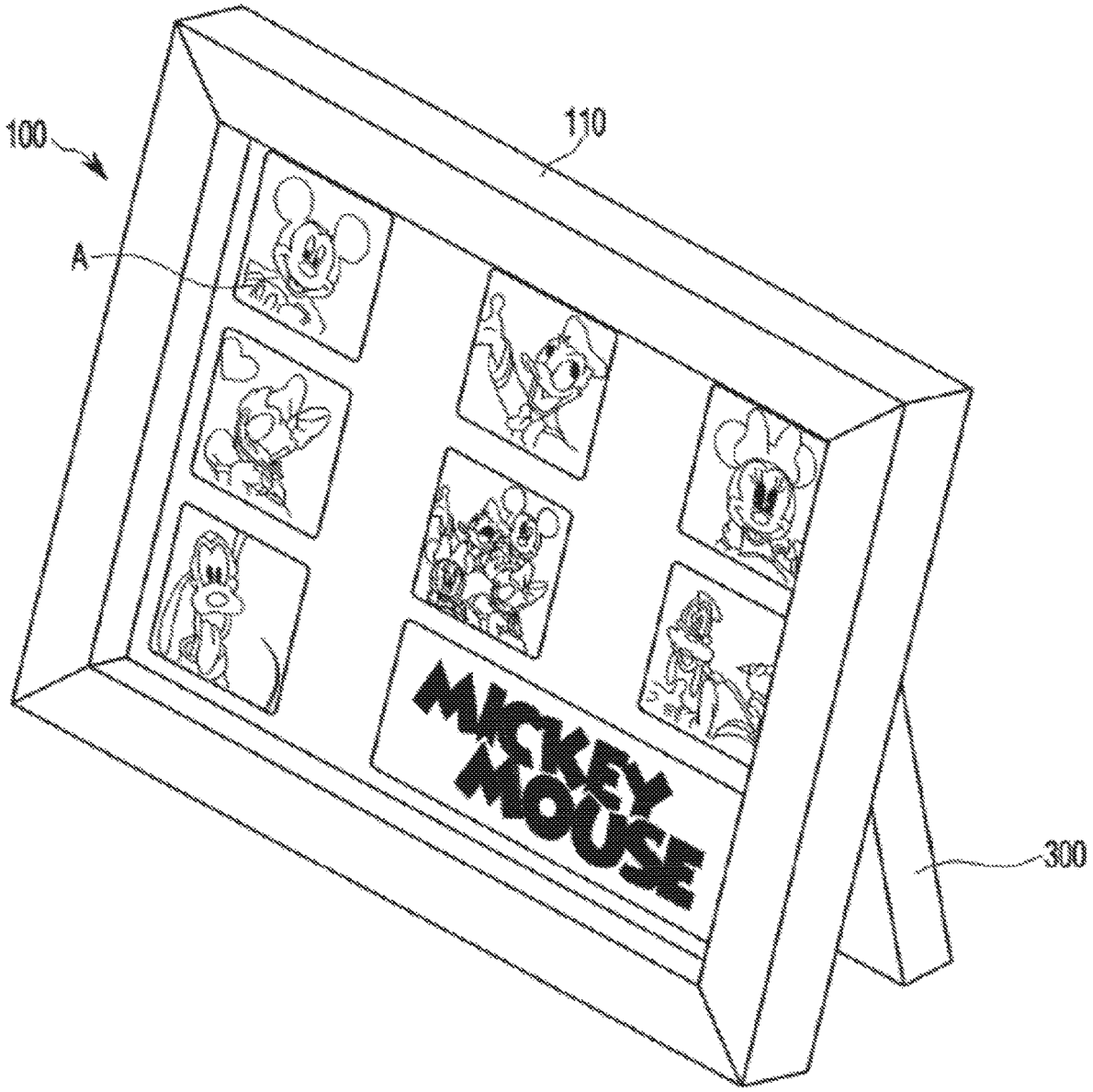
FIG. 1 is a view schematically showing a chocolate case according to an embodiment of the present invention.
Figure 2:
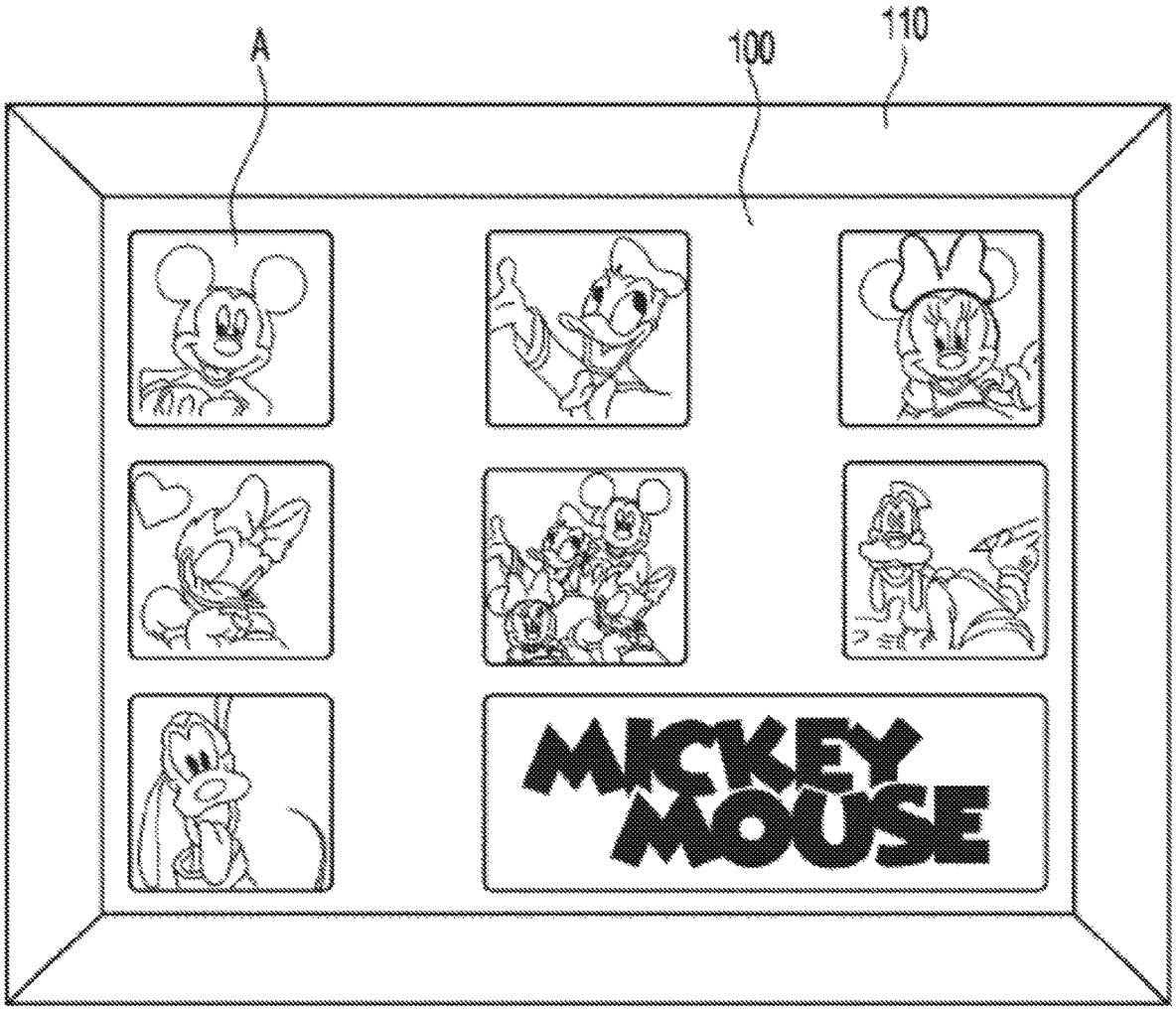
FIG. 2 is a view showing a main body part of the chocolate case according to the embodiment of the present invention.
Figure 3:
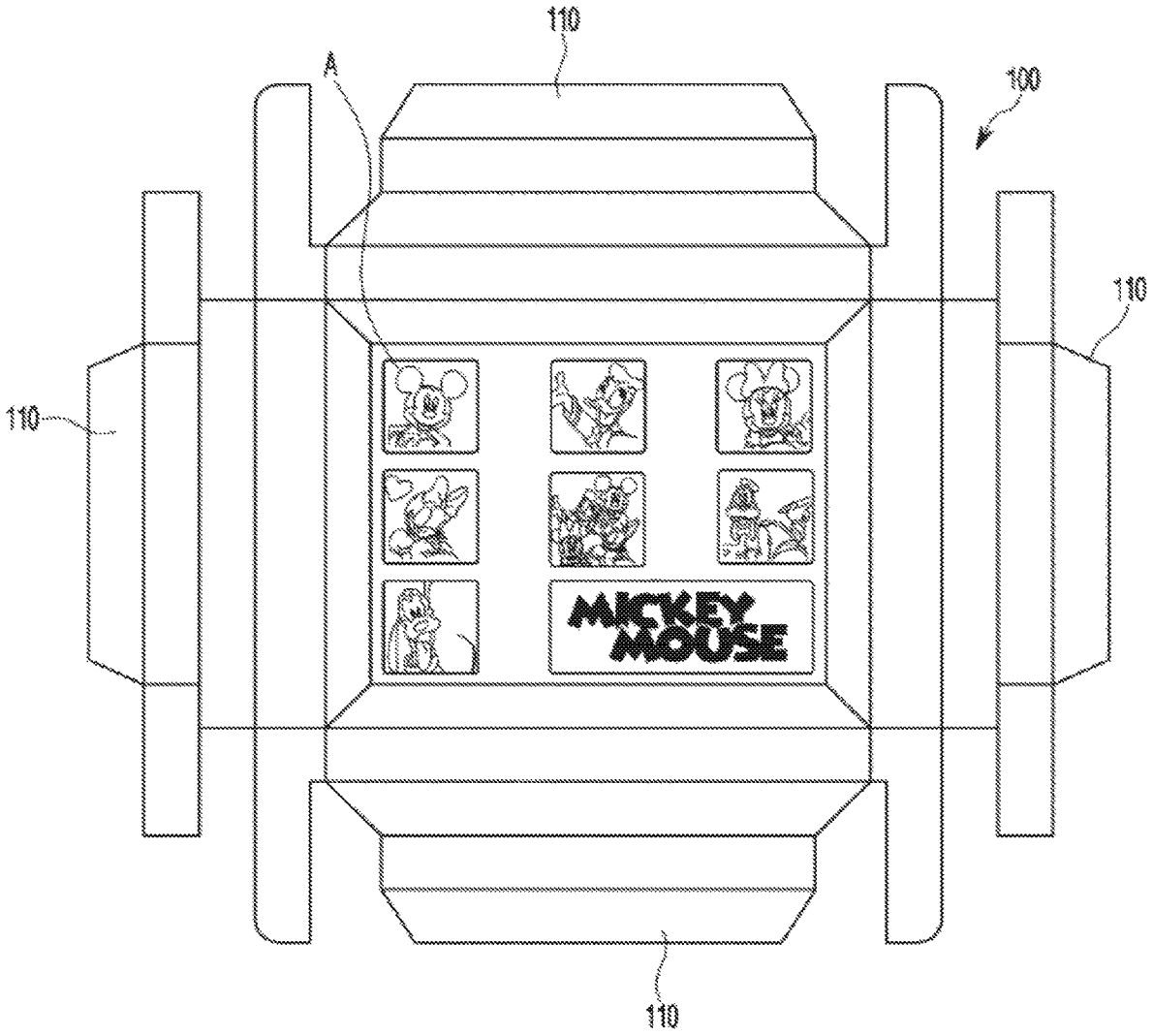
FIG. 3 is a development view of the main body part of the chocolate case according to the embodiment of the present invention.

FIG. 1 is a view schematically showing a chocolate case according to an embodiment of the present invention, FIG. 2 is a view showing a main body part of the chocolate case according to the embodiment of the present invention, and FIG. 3 is a development view of the main body part of the chocolate case according to the embodiment of the present invention.

As shown in FIG. 1, a chocolate case according to this embodiment includes a main body part 100, a chocolate constituent part (not shown), and a support part 300.

First of all, the main body part 100 has a plurality of printed surfaces A that are partitioned so as to be exposed to the front and which is provided with frames 110 protruding in the front and rear and left and right directions, as shown in FIG. 2.

The main body part 100 may be provided so that the plurality of printed surfaces A are all formed in the same design, or each of which has a different design.

That is, the printed surfaces A may be formed of an animation character, a game character, an emoticon character, or the like. Among these characters, the same character with high preference may be partitioned and formed as each of the printed surfaces A, or a plurality of different characters may be partitioned and formed as each of the printed surfaces A. As a result, a wide selection of products can be secured, and customer satisfaction can also be improved Herein, the main body part 100 may be provided with a material of paper. In addition, the main body part 100 may be unfolded on a plane and may be assembled to form frames 110, which are protruded from the main body part, by folding along a plurality of cutting lines placed on the top and bottom and the left and right in a state in which the plurality of printed surfaces A are placed in the center thereof, as shown in FIG. 3.

Accordingly, the main body part 100 has a foldable structure as described above, so the assembly for completing the case is easily accomplished. In addition, since the main body part 100 is made of a paper material, it is light in weight and can be easily handled.

In this embodiment, in order to maximize the above advantages of the main body part 100 as described above, the main body part 100 is limited to the paper material, but this only corresponds to one embodiment. As an example, in order to prevent damage by water, etc., and to use it for a long time, the main body part 100 may be made of any one of a plastic material in which the frame 110 is integrally manufactured by an injection molding, or a wood material processed to have the frame 110.

Figure 4:
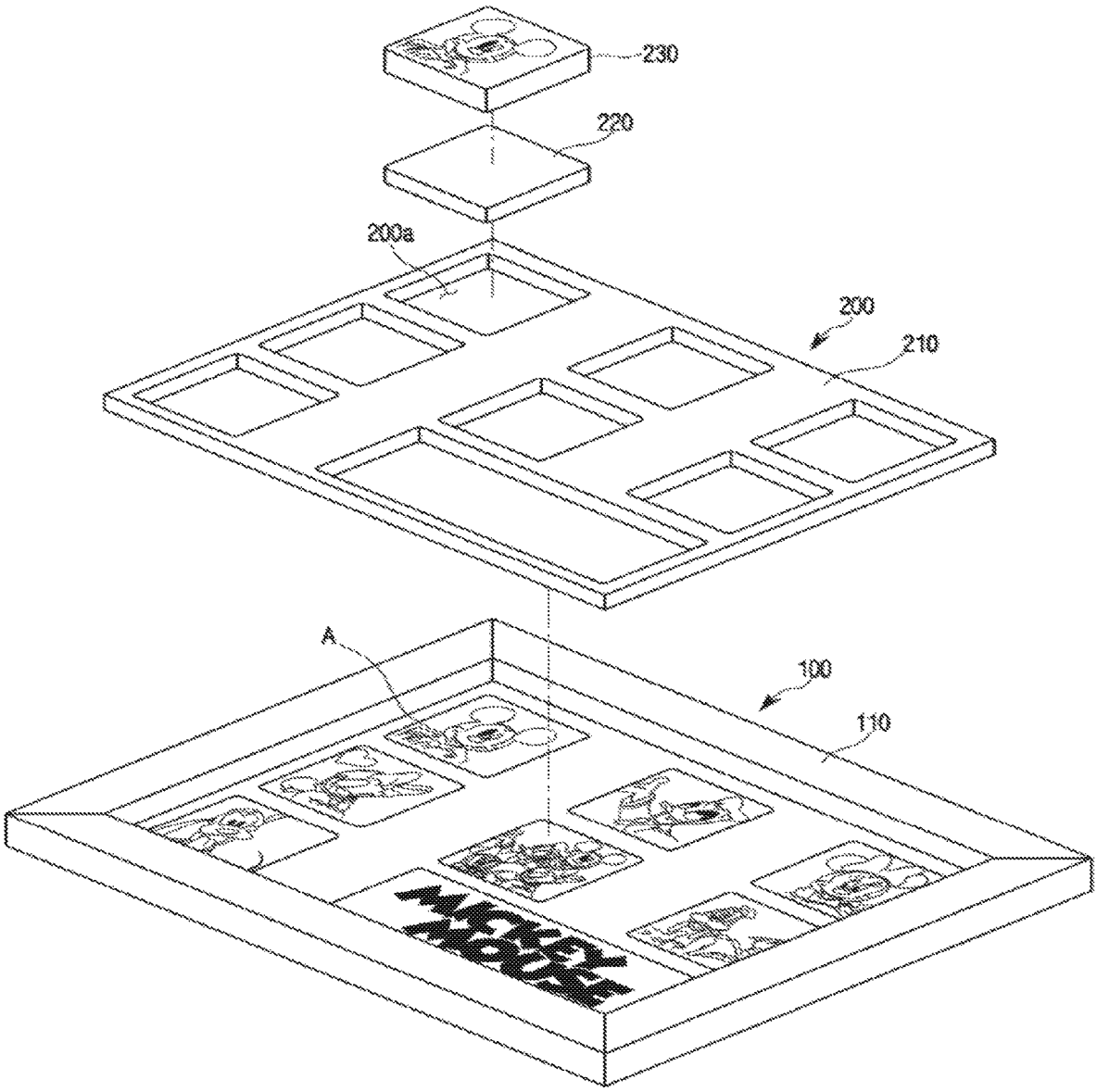
FIG. 4 is a view showing a configuration of a chocolate constituent part of the chocolate case according to the embodiment of the present invention.
Figure 5:
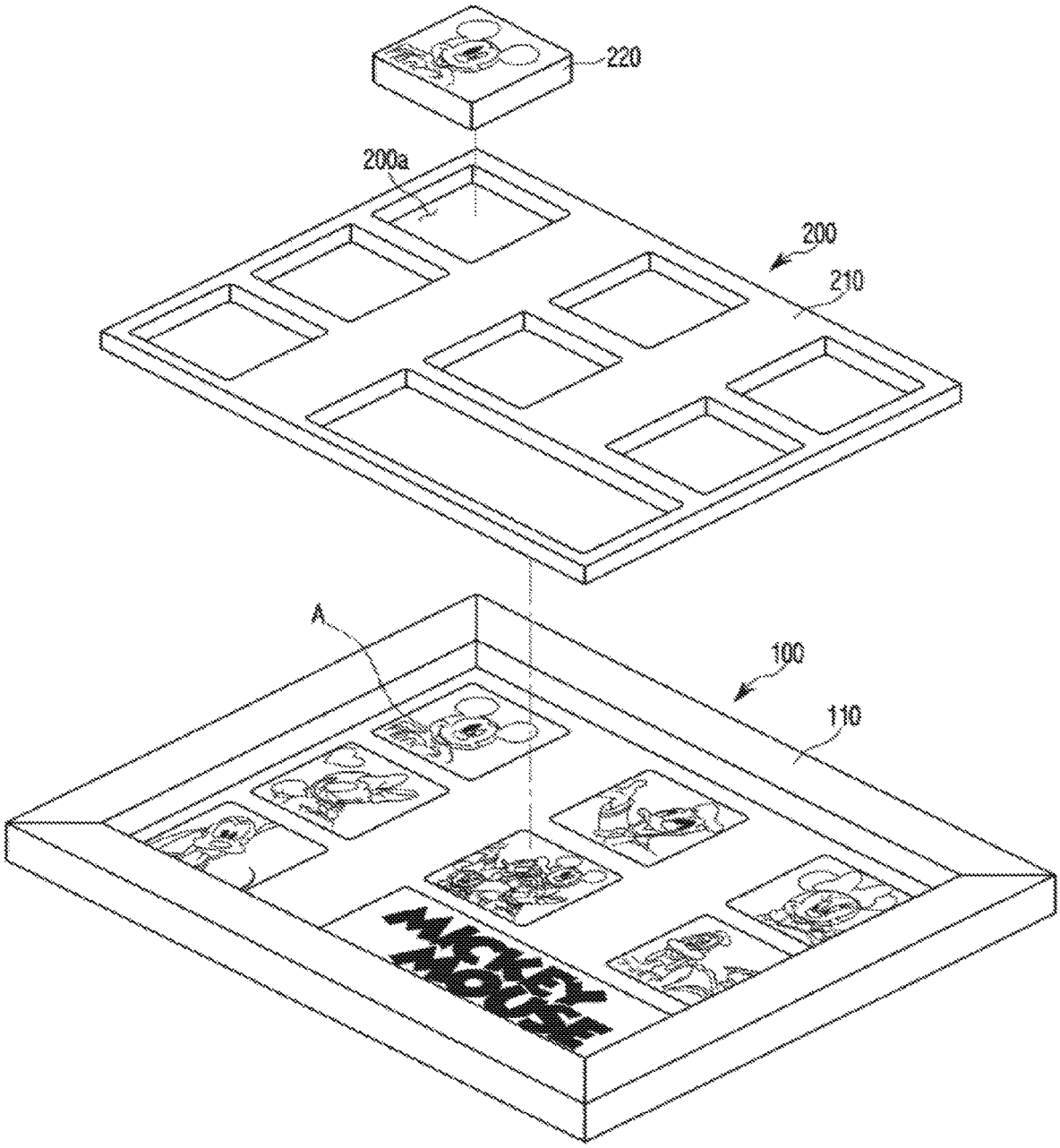
FIG. 5 is a view showing another configuration for the chocolate constituent part of the chocolate case according to the embodiment of the present invention.

Hereinafter, FIG. 4 is a view showing a configuration of a chocolate constituent part of the chocolate case according to the embodiment of the present invention, and FIG. 5 is a view showing another configuration for the chocolate constituent part of the chocolate case according to the embodiment of the present invention.

As shown in FIG. 4, the chocolate case according to this embodiment may include the main body part 100, the chocolate constituent part 200 and the support part 300, wherein the chocolate constituent part 200 includes a plurality of accommodation regions 200*a* partitioned to correspond to a plurality of printed surfaces A.

In addition, the chocolate constituent part 200 may be formed so that the same designs as the designs of the printed surfaces A are exposed to the front, in a state in which the chocolates are seated inside the accommodation regions 200*a*, more specifically, at the positions corresponding to the plurality of printed surfaces A.

To this end, the chocolate constituent part 200 includes a seating frame 210, the chocolates 220, and the printed packaging papers 230.

The seating frame 210 may be made of a plastic material to prevent damage such as color deformation by the chocolate 220 accommodated therein. Accordingly, the seating frame 210 may be formed by partitioning a plurality of accommodation regions 200*a* to correspond to the printed surfaces A so that the plurality of printed surfaces A are exposed to the outside even after the seating frame 210 is coupled to the main body part 100.

The chocolates 220 may have sizes corresponding to the sizes of the accommodation regions 200*a*, and more preferably have sizes corresponding to the sizes of the printed surfaces A to be placed therein.

In this embodiment, the chocolate 220 is used as a product placed inside the accommodation region 200*a*, but is not limited thereto. As an example, the chocolate 220 may be another product that can be consumed, such as candies, jellies, confectionery, and the like.

The printed packaging papers 230 have the same front surface designs as the designs of the plurality of printed surfaces A formed on the main body part 100 and serves to package the chocolates 220 placed in positions corresponding to the printed surfaces A.

In other words, the same designs as the plurality of printed surfaces A are individually printed on the front surface of the printed packaging papers 230. Accordingly, in packaging the chocolates 220, the chocolates 220 placed in the positions corresponding to the printed surfaces A are individually packaged so that the same printed surfaces as the plurality of printed surfaces A are exposed to the outside.

Although not shown in the drawings, the chocolate constituent part 200 may further include a cover member (not shown), and shield the main body part 100 to protect the chocolates 220 from the outside.

In this embodiment, the chocolates 220 may be packaged such that the designs printed on the printed packaging papers 230 have the same designs as the plurality of printed surfaces A inside the main body part 100. Accordingly, the consumers may look and purchase the designs printed on the printed packaging papers 230. In this case, even if the printed packaging papers 230 are thrown away after the purchased chocolates 220 are consumed, since the same designs as the printed packaging papers 230 are present on the main body part 100, the consumers may be able to own the designs, and thus the main body part 100 may be recycled.

Accordingly, in the present embodiment, through recycling of the main body part 100, it is possible to improve the problems of environmental pollution and resource waste due to the chocolate cases that were thrown away in the past. In addition, since the main body part 100 has a frame 110, they can be used as picture frames.

Meanwhile, as shown in FIG. 5, the chocolate constituent part 200 according to the present embodiment may include a seating frame 210 and chocolates 220.

That is, the seating frame 210 may be provided in the same manner as in the above-described embodiment. The chocolates 220 are placed in the accommodation regions 200*a* at the positions corresponding to the printed surfaces A in a state in which the same designs as the designs of the printed surfaces A formed on the main body part 100 are printed on the front surfaces.

In other words, on the front surface of the chocolate 220, the same design as the designs of the printed surfaces A formed on the main body part 100 may be printed through edible ink. Accordingly, even after the chocolates 220 are consumed, since the same designs are present on the main body part 100, the consumers may be able to own the designs, and thus the main body part 100 may be recycled.

Accordingly, in this embodiment, since the same designs as the printed surfaces A are printed on the front surfaces of the chocolates 220 with the edible ink, the separate configuration of the printed packaging paper 230 may be deleted, and accordingly, since the amount of waste thrown away can be reduced, the problems of environmental pollution and resource waste can be improved.

Figure 6:
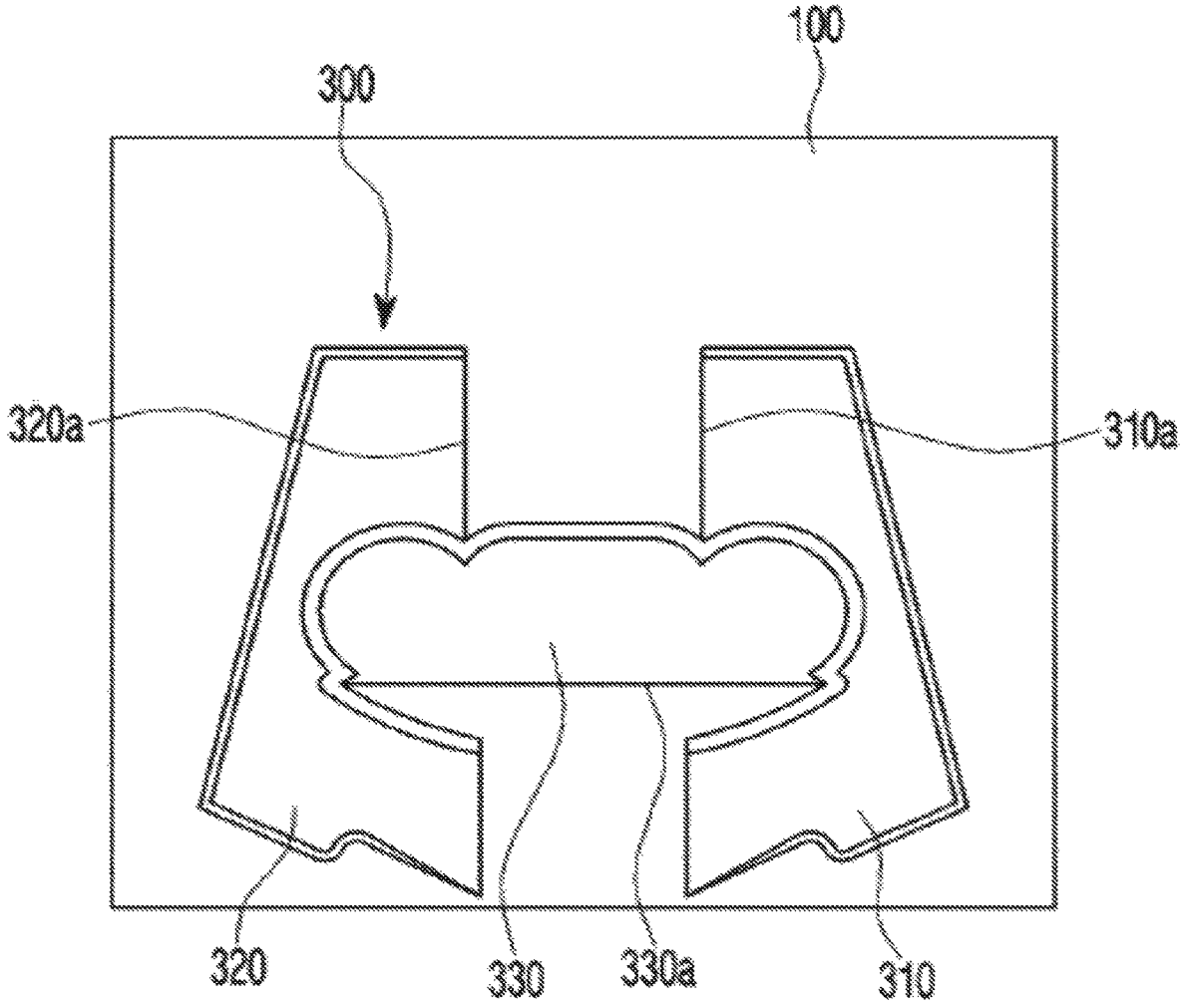
FIG. 6 is a view showing rear cutting lines for the main body part of the chocolate case according to the embodiment of the present invention.
Figure 7:
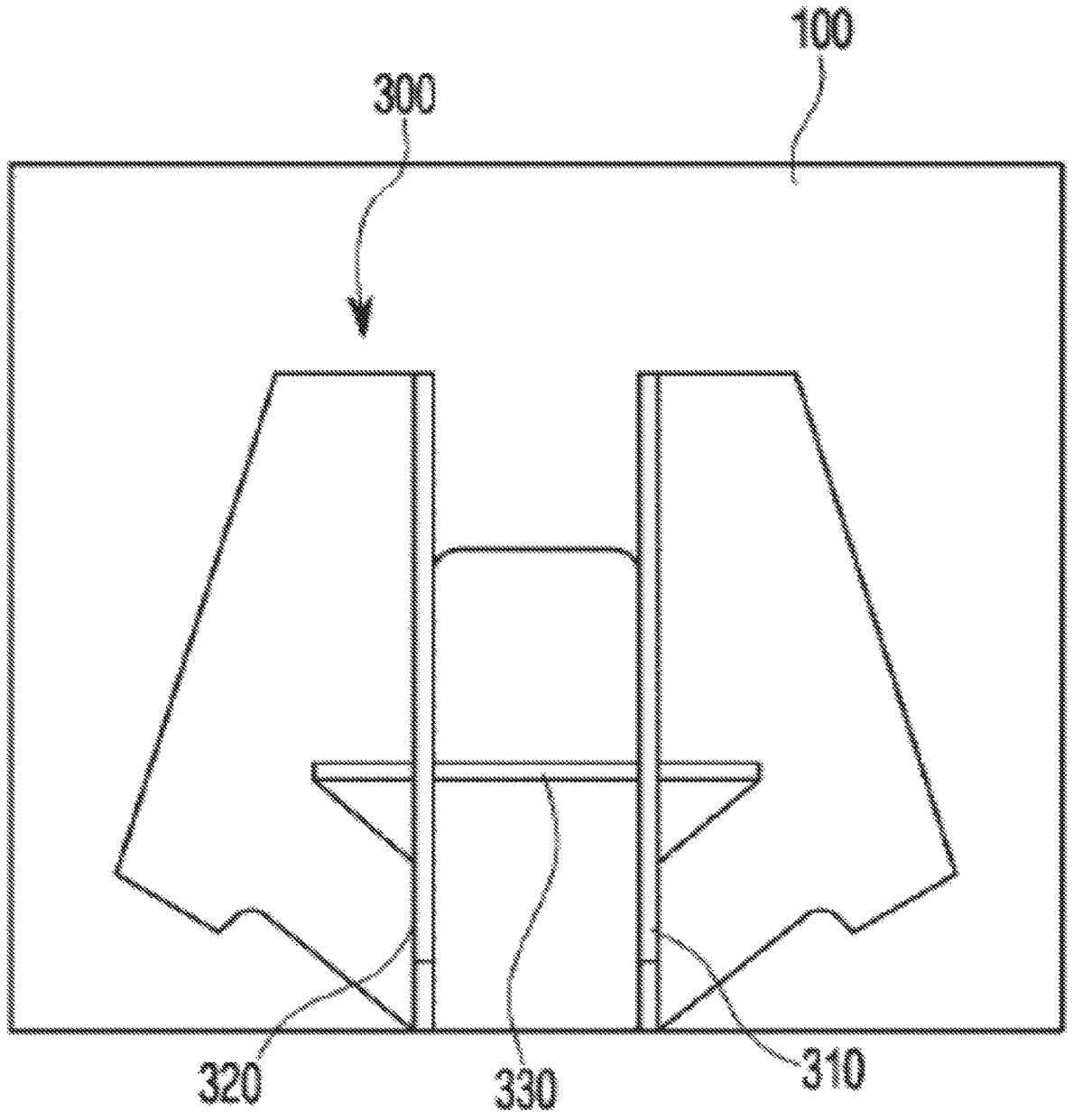
FIG. 7 is a view showing an unfoldable structure of a support part of the chocolate case according to the embodiment of the present invention.
Figure 8:
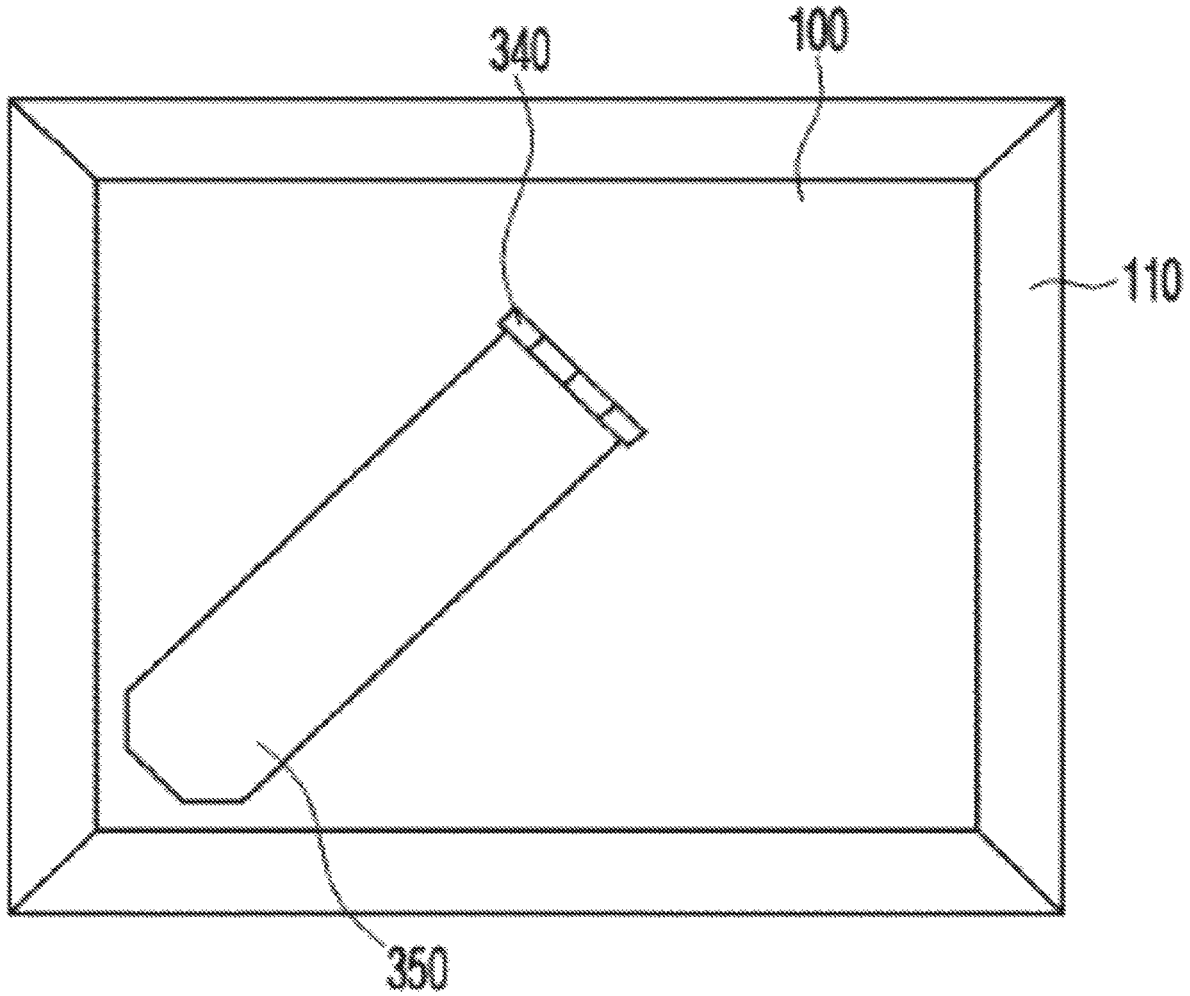
FIG. 8 is a view showing another unfoldable structure for the support part of the chocolate case according to the embodiment of the present invention.

Hereinafter, FIG. 6 is a view showing rear cutting lines for the main body part of the chocolate case according to the embodiment of the present invention, FIG. 7 is a view showing an unfoldable structure of a support part of the chocolate case according to the embodiment of the present invention, and FIG. 8 is a view showing another unfoldable structure for the support part of the chocolate case according to the embodiment of the present invention.

As shown in FIG. 6, the chocolate case according to this embodiment includes a main body part 100, a chocolate constituent part 200 and a support part 300, wherein the support part 300 may be provided on the rear of the main body part 100 to selectively support the main body part 100.

To this end, the support part 300 according to the present embodiment may include a first support member 310, a second support member 320 and a fixing member 330.

First of all, the first support member 310 may be provided with the same material as the main body part 100, more specifically, a paper material, and may be selectively unfolded toward the rear of the main body part 100 along a first cutting line 310*a*.

The first support member 310 may be unfolded when the main body part 100 is supported and used as a picture frame, and since it is made of paper material, it can be easily unfolded only by simply folding it along the first cutting line 310*a*.

Likewise, the second support member 320 may be made of the same paper material as the first support member 310, and may be selectively unfolded along a second cutting line 320*a* provided in a position corresponding to the first cutting line 310*a* with respect to the rear center of the main body part 100.

The second support member 320 may be formed in the same size and shape as the first support member 310, and may be easily unfolded by simply folding it along the second cutting line 320*a* in the same way as the first support member 310. As a result, it allows to easily support the main body part 100 inclined to the rear together with the unfolded first support member 310.

In addition, the fixing member 330 may be unfolded along a third cutting line 330*a* connecting the first cutting line 310*a* and the second cutting line 320*a*, that is, along the vertical direction toward the first support member 310 and the second support member 320 that are unfolded facing each other along the horizontal direction.

Accordingly, the fixing member 330 may be fitted in the longitudinal direction of the first and second support members 310 and 320 as shown in FIG. 7, and the first and second support members 310 and 320 may be fitted in a supported state, such that after the chocolates 220 are consumed, the main body part 100 can be easily supported when the main body part 100 is used as a picture frame.

Although not shown in the drawings, a fourth cutting line may be provided in addition to the first to third cutting lines 310*a*, 320*a*, and 330*a*. This fourth cutting line may be configured to have the shape of a ring when unfolding, so that the main body part 100 may be used as a picture frame as described above, and may also be used as a wall hanging and the like.

Meanwhile, the support part 300 according to the present embodiment may include a connection member 340 and a support member 350 as shown in FIG. 8.

The connection member 340 may be coupled in a diagonally placed state at the rear of the main body part 100.

In addition, the support member 350 may be selectively unfolded rearward along the coupled direction with the connection member 340 and moved away from the rear surface of the main body part 100 by a predetermined distance, such that the main body part 100 may be supported in a state inclined to the rear. Therefore, after the chocolates 220 are consumed, the main body part 100 may be used as a picture frame.

In addition, the support member 350 may be made of the same material as the material of the main body part 100, for example, may be made of wood material, and may include a stopper (not shown) for fixing a position in a state in contact with the rear surface of the main body part 100.

In addition, although not shown in the drawings in this embodiment, a hanging member may be provided in addition to the connection member 340 and the support member 350. Such a hanging member may be configured to have the shape of a ring, so that the main body part 100 may be used as a picture frame and may also be used as a wall hanging and the like.

According to the present invention, a chocolate case may be provided, which has a plurality of partitioned accommodation regions, is formed so that the interior design of the accommodation regions is the same as the front surface design of chocolates, and is also capable of being selectively supported through cutting members provided to be unfold reward. Accordingly, the present invention has an effect in that the chocolate case can be recycled as a picture frame after the accommodated chocolates are consumed.

Accordingly, according to the present invention, since the consumers can permanently possess the chocolate case having the same design as the front design of the chocolate, and the discarded chocolate case can be used as a picture frame, the present invention has the effect improving the problems of environmental pollution and resource waste.

It will be understood that although the present invention has been described with reference to the embodiment(s) shown in the drawings, this is only exemplary, and various modifications may be made therefrom by those skilled in the art. In addition, it will be understood that all or part of the embodiment(s) described above may be selectively combined and configured. Accordingly, the true technical protection scope of the present invention should be defined by the technical spirit of the appended claims.

EXPLANATION OF REFERENCE SIGNS

| | |
|---|---|
| 100: main body part | 110: frame |
| 200: chocolate constituent part | 200a accommodation region |
| 210: seating frame | 220: chocolate |
| 230: printed packaging paper | 300: support part |
| 310: first support member | 310a: first cutting line |
| 320: second support member | 320a: second cutting line |
| 330: fixing member | 330a: third cutting line |
| 340: connection member | 350: support member |
| A: printed surface | |

The invention claimed is:

1. A chocolate case comprising:

a main body part having a plurality of printed surfaces that are partitioned so as to be exposed to a front of the case, each of the plurality of printed surfaces having an image design;

a chocolate constituent part which has a plurality of accommodation regions for placing chocolates therein, wherein the plurality of accommodation regions are partitioned so as to correspond to the plurality of printed surfaces, and the chocolate constituent part is formed so that the image design of each of the plurality of printed surfaces are exposed to the front when placed inside the plurality of accommodation regions;

a support part which is provided at a rear of the main body part and which enables the main body part to be selectively supported; and a seating frame in which the plurality of accommodation regions are partitioned and formed;

wherein the support part includes:

a first support member made of a paper material and formed to be selectively unfolded along a first cutting line;

a second support member made of same material as the first support member and formed to be selectively unfolded along a second cutting line at a position symmetrical to the first cutting line with respect to a rear center of the main body part; and a fixing member selectively unfolded along a third cutting line connecting the first cutting line and the second cutting line, and fitted in a longitudinal direction of the first and second support members;

wherein the support part includes:

a connection member coupled to the rear of the main body part; and a support member rotatably coupled to the connecting member and formed to be selectively unfolded.

2. The chocolate case according to claim 1, wherein the main body part is made of a paper material, and is configured to form frames by folding along a plurality of cutting lines in a state where the plurality of printed surfaces are placed in a center of the main body part.

3. The chocolate case according to claim 1, wherein the main body part is a plastic material manufactured by an injection molding or a processed wood material.

4. The chocolate case according to claim 2, wherein the support part is made of a same material as that of the main body part.

5. The chocolate case according to claim 1, further comprising:

printed packaging papers for individually wrapping the chocolates, each of printed packaging papers having a front design identical to the image design of a printed surface among the plurality of printed surfaces, wherein the front design has same size and orientation as the image design of the printed surface and is positioned at a location to be exposed externally.

6. The chocolate case according to claim 1, wherein the main body part is provided so that the image design of each of the plurality of printed surfaces is either same or different.

* * * * *